US006462292B1

(12) United States Patent
Wang

(10) Patent No.: US 6,462,292 B1
(45) Date of Patent: Oct. 8, 2002

(54) SEE-SAW SWITCH

(75) Inventor: Ming-Shan Wang, Taipei (TW)

(73) Assignee: Tsung-Mou Yu, Taipei Hsien (TW)

( * ) Notice: Subject to any disclaimer, the term of this patent is extended or adjusted under 35 U.S.C. 154(b) by 36 days.

(21) Appl. No.: 09/715,157

(22) Filed: Nov. 20, 2000

(51) Int. Cl.[7] ..... H01H 9/02; H01H 23/28

(52) U.S. Cl. ..... 200/315; 200/553; 200/293; 200/339

(58) Field of Search ..... 200/553–557, 200/315, 339

(56) References Cited

U.S. PATENT DOCUMENTS 3,371,179 A * 2/1968 Lohr ..... 200/339 X
4,037,068 A * 7/1977 Gaynor ..... 200/339 X
5,694,106 A * 12/1997 Wang ..... 337/53
5,760,672 A * 6/1998 Wang ..... 337/66

* cited by examiner

*Primary Examiner*—J. R. Scott
(74) *Attorney, Agent, or Firm*—Rosenberg, Klein & Lee

(57) ABSTRACT

A see-saw switch is provided where two ends of the switch housing opposite to the button, respectively include a narrow U-groove formed therethrough. A resilient piece is disposed in each groove and only one end thereof is fixed. The inner rim face of each resilient piece is formed in an arched body contour. The bottom ends of the button have a respective projection that is used to press against the arched body shaped inner rim face of the resilient piece for maintaining the position of the button until it is displaced by a user.

2 Claims, 7 Drawing Sheets

SEE-SAW SWITCH

BACKGROUND OF THE INVENTION

1. Field of the Invention

The present invention relates to a see-saw switch, and more particularly, to a switch which is simplified in configuration, convenient in assembly and improved in the electric connection quality thereof.

2. Description of the Prior Art

The conventional see-saw switch 7, as shown in FIGS. 7 and 8, includes a see-saw type button 71. When either side of the button 71 is pressed down, a push cylinder 72 at the bottom thereof is pressed against a see-saw conductive piece 74 due to the resilience of the pressure spring 73. As a result, a disconnection (Off) state or a connection (On) state is achieve.

However, the conventional see-saw switch still has the following drawbacks:

In order to achieve a see-saw movement of the conductive piece 74 on a pivoting point of a groove 751 of a conductive plate 75, a recessed area 711 has to be formed at center of the button 71 for receiving a push cylinder 72 and a conductive spring wire 78. The number of components is therefore increased so that the amount of labor and the production cost in assembly must be increased as well.

The conductive piece 74 is easily worn or loosened due to the continuous see-saw movement on top of the groove 751. In addition, the push cylinder 72 makes a reciprocating movement on the conductive piece 74. As a result, the pressure spring 73 fatigues after a long period of use, and the pressing force of the push cylinder 72 is reduced, influencing the effectiveness of the electric continuity of the switch.

The push cylinder 72 is disposed at center of the switch housing so that the neon light 76 can only be mounted on the top of the recessed area 711 and has to be moved with the button 71. As a result, a conductive spring wire 78 has to be fitted at the top of a third conductive plate 77 in order to connect to the neon light 76 and supply power thereto. This is not only impractical to assembly, but the malfunction rate is also higher.

SUMMARY OF THE INVENTION

It is a primary object of the present invention to provide a see-saw switch whose components are simplified and whose assembly is more convenient and faster.

It is another object of the present invention to provide a see-saw switch which has improved electric continuity quality.

It is a further object of the present invention top provide a see-saw switch whose volume is reduced.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
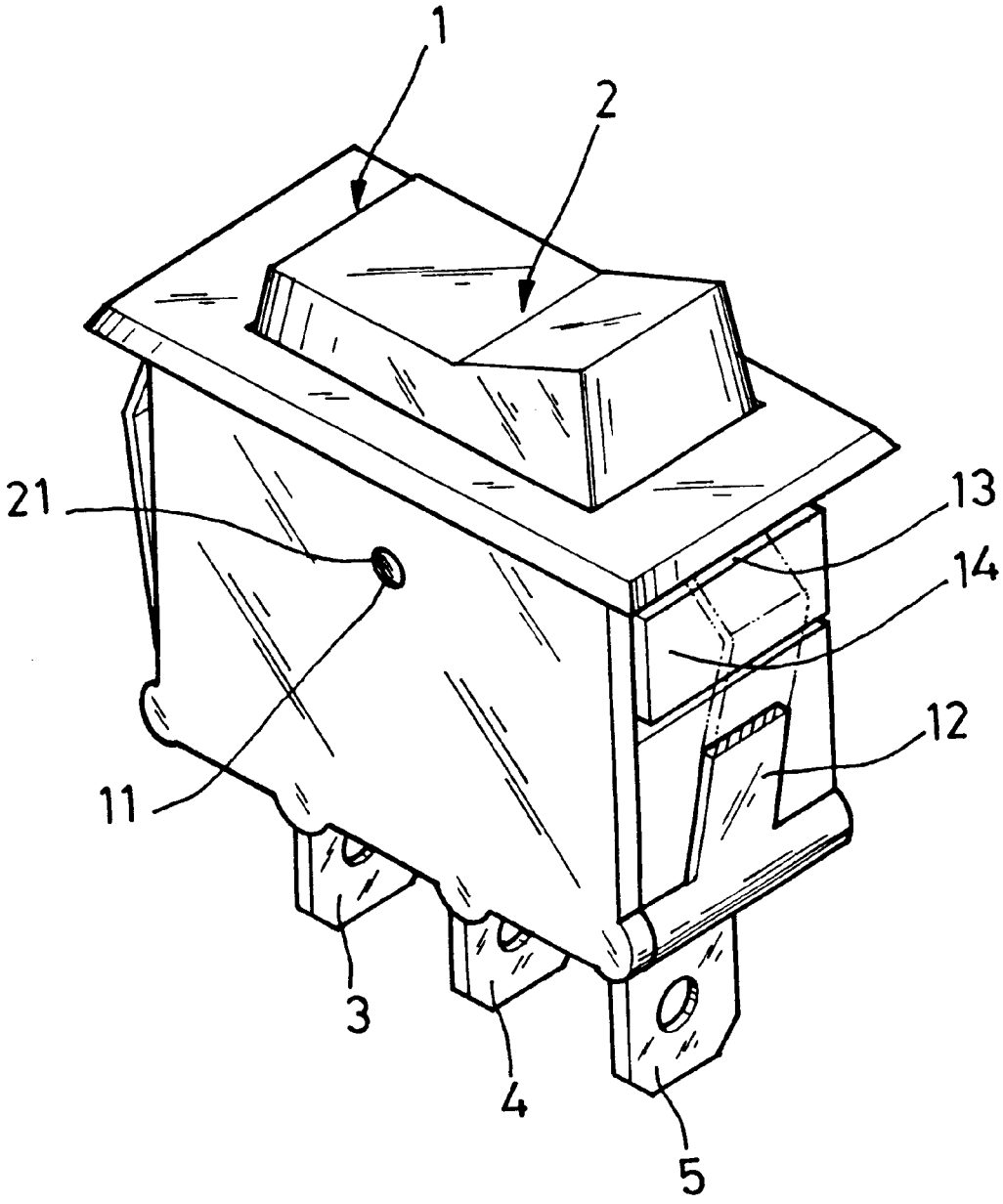
FIG. 1 is a perspective view of a preferred embodiment of the present invention.
Figure 2:
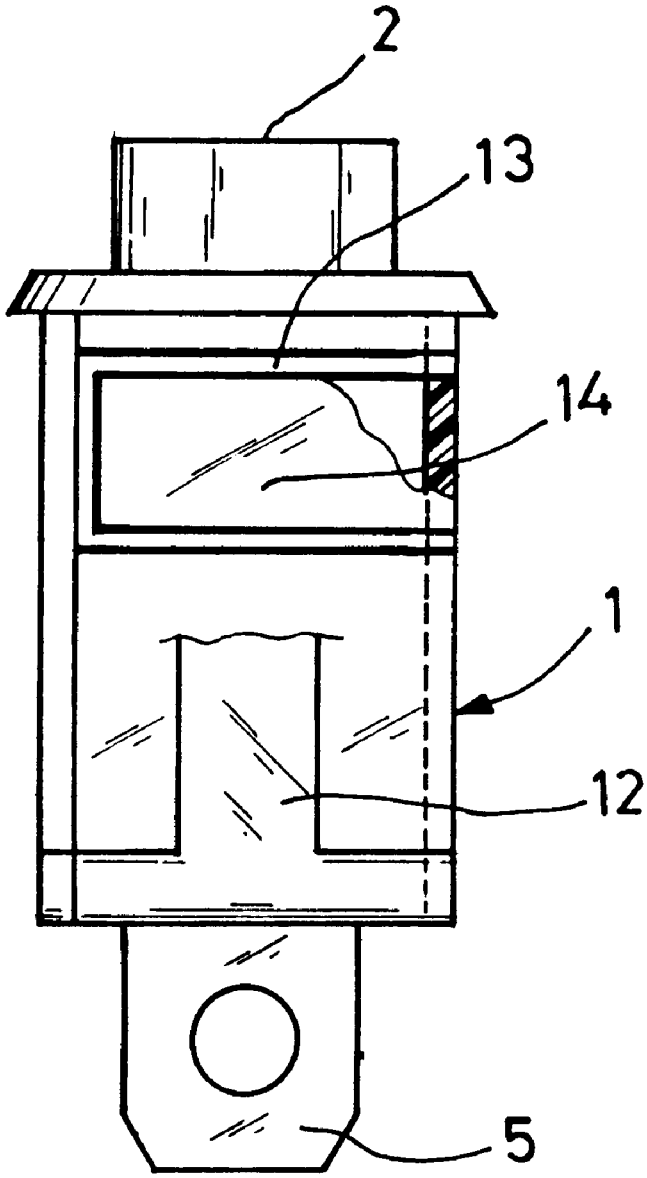
FIG. 2 is a side view of the preferred embodiment of the present invention.
Figure 3:
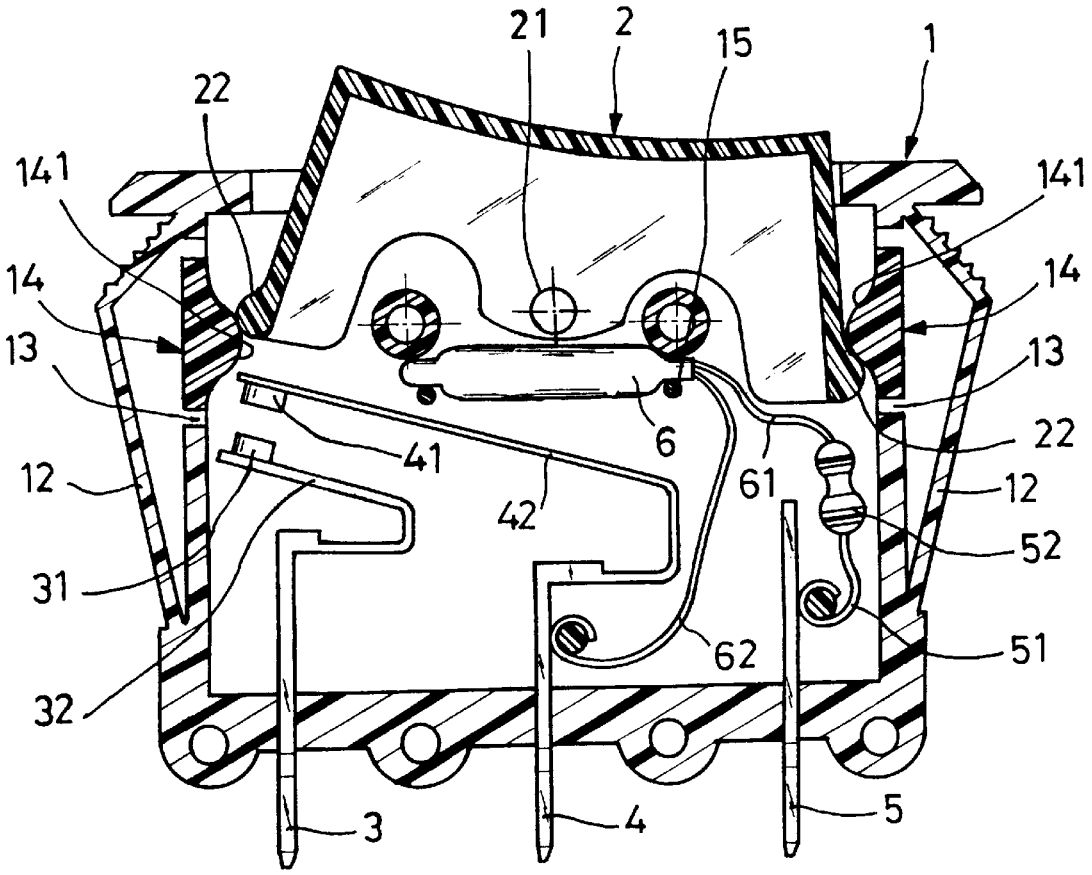
FIG. 3 is a sectional view of the preferred embodiment of the present invention showing its OFF-state.

First, referring to FIGS. 1 through 3, the see-saw switch in accordance with a preferred embodiment of the present invention includes:

a switch housing formed by a hollow case and having a pivoting hole 11 formed in each of two opposing sides thereof for respectively receiving the small round projections 21 of a button 2 therein, to pivotally mount the button 2 at an upper end of the switch housing. A resilient locking hook 12 is respectively disposed at opposing ends of the switch housing 1.

Three conductive plates 3, 4 and 5 extend through the housing 1. The first and third conductive plates 3 and 5 are connected with a power cable (not shown). The top of the first conductive plate 3 is provided with a first bending portion 32 having a first platinum conductive boss 31 fixed thereon. The top of the second conductive plate 4 is provided with a second bending portion 42 having a second platinum conductive boss 41 fixed thereon and disposed opposite to and spaced from the first platinum conductive boss 31 of the first conductive plate 3. The third conductive plate 5 is joined to a resistance 52 by means of a conductive wire 51.

A neon lamp 6 is disposed under the button 2 and positioned by means of a lot of locating posts 15. Two conductive wires 61 and 62 of neon lamp 6 are respectively secured to the resistance 52 and the second conductive plate 4. The neon lamp 6 lights up to show a connecting state when the first conductive plate 3 and the second conductive plate 4 are electrically connected together.

The present invention is characterized in that two ends of the switch housing 1, opposite to the button 2, respectively include a narrow U-groove 13 formed therethrough, in which a resilient piece 14 is disposed and only one end thereof is fixed. The inner rim face 141 of the resilient piece 14 is formed with an arched body contour. Projections 22 are used to press against the arched body shaped inner rim faces 141 of the resilient pieces 14 for releasably fixing the button 2 in place, the projections 22 are respectively formed at two bottom ends of the button 2.

The resilient piece 14 disclosed in the above-mentioned embodiment of the present invention can be disposed in the narrow U-groove 13 at either or both of right and left end walls. A projection 22 of the button 2 is formed to correspond with each of the resilient pieces 14. If two resilient pieces 14 are present, then two projections 22 should be correspondingly installed. However, only one resilient piece 14 is, in fact, sufficient for functioning to maintain the button 2 in the On/Off positions. Certainly, the use of two resilient pieces 14 will increase the quality of the button's operation and prolong its service life.

The operation and the effect performed and achieved by the above-mentioned technique and features of the present invention are described in following paragraphs.

First, referring to FIG. 3, the Off-state of the switch is shown. The button 2 rotates about the small round projections 21, and the left side thereof is raised. In the raised position, the left side doesn't contact the second bending portion 42 and the second platinum conductive boss 41 of the second conductive plate 4 is spaced from the first platinum conductive boss 31 of the first conductive plate 3, so that the first conductive plate 3 and the second conductive plate 4 are in a disconnected state. At this time, the projections 22 of the button 2 are pressed against respective arched body shaped inner rim faces 141 of the resilient piece 14. Unless the right side of the button 2 is pressed, the disconnected state will always be maintained.

Figure 4:
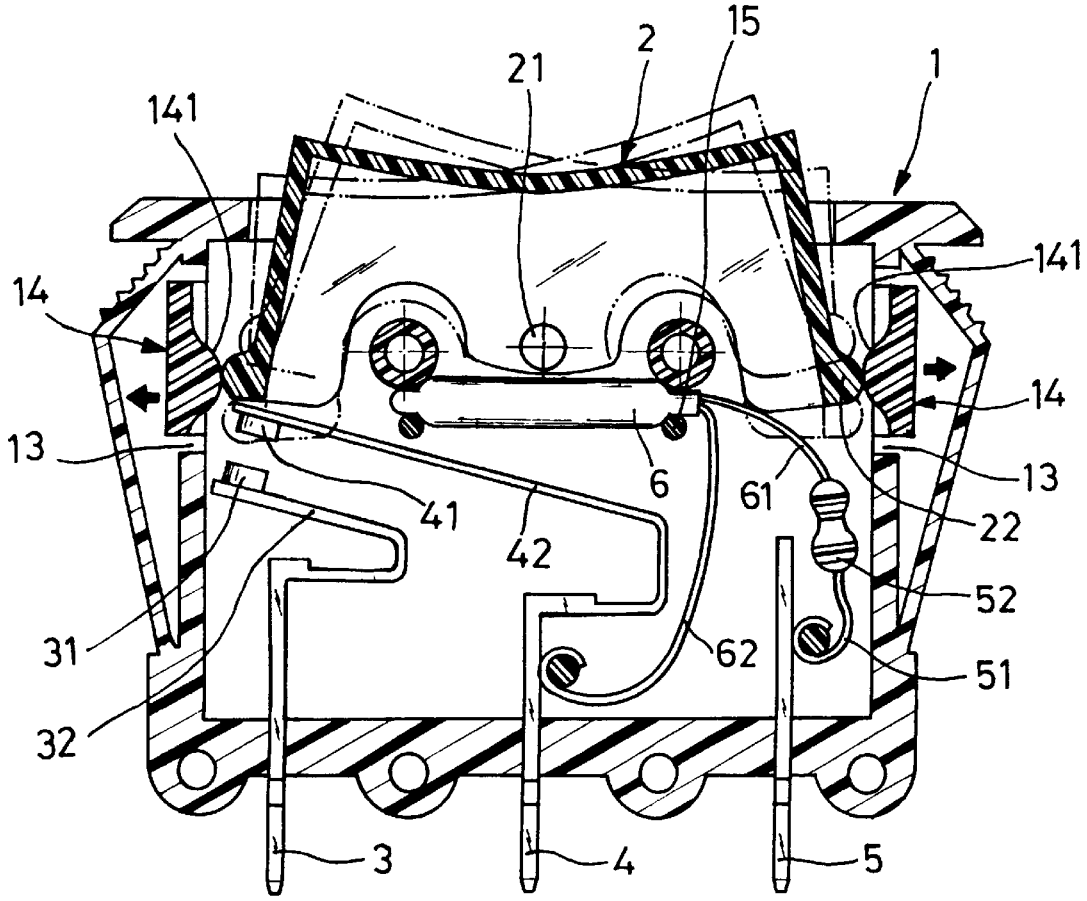
FIG. 4 is a sectional view of the preferred embodiment of the present invention showing the resilient piece in pressing the button.
Figure 5:
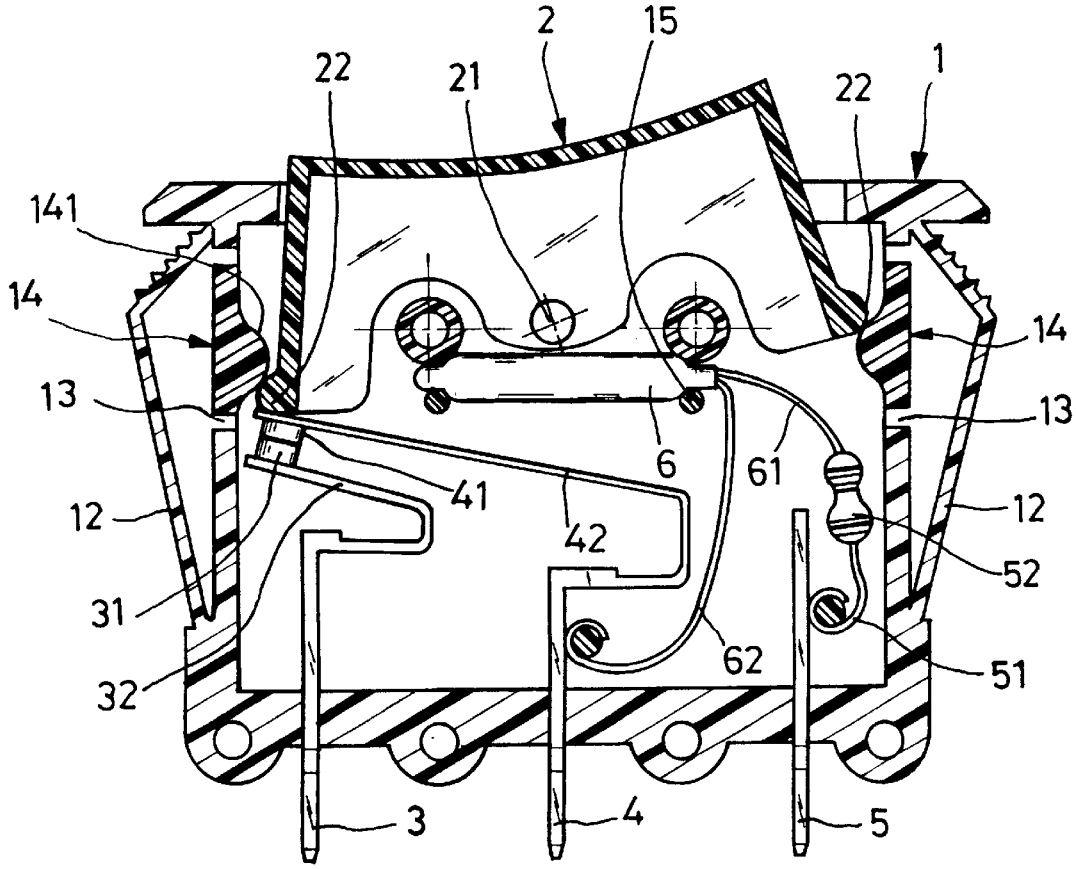
FIG. 5 is a sectional view of the preferred embodiment of the present invention showing the On-state.

FIG. 4 shows the left side of the button 2 of the present invention being pressed. At this time, the projections 22 slide over the top of the arched body shaped inner rim faces 141 of the resilient piece 14, while the resilient piece 14 is pressed outwardly in order for the projections 22 to pass by the arched body shaped inner rim faces 141. Meanwhile, the resilient piece 14 restores itself by means of its resilience (see FIG. 5). Moreover, the right side of the button 2 is raised, and the projection 22 at the left bottom end thereof is pressed against the second platinum conductive boss 41 at the top end of the second bending portion 42 of the second conductive plate 4 to displace the second platinum conductive boss 41 into contact with the first platinum conductive boss 31. As a result, the second platinum conductive boss 41 and the first platinum conductive boss 31 are connected to define the On-state. When the first conductive plate 3 and the second conductive plate 4 are in an electrically connected state, the neon lamp 6 lights up to indicate that the switch is in the On-state.

In the On-state, the let projection 22 of the button 2 is located on the bottom face of the arched body shaped inner rim face to maintain the second platinum conductive boss 41 in contact with the first platinum conductive boss 31. Thus, the button 2 is thereby releasably locked in place. Even if the left resilient piece 14 is not installed and only the right resilient piece 14 is present, the right projection 22 will also be releasably locked in the recess of the right arched body shaped inner rim face 141. Before the button 2 is pressed again, it is ensured that the second platinum conductive boss 41 will be maintained in contact with the first platinum conductive boss 31. The button 2 is releasably locked in place for the On/Off state by either of the left or the right sides of the switch housing 1 being fitted with the resilient piece 14. Of course, the installation of both of the resilient pieces 14 will enhance the quality of the switching operation and prolong its service life.

Moreover, the present invention, in comparison with the conventional see-saw switch 7, obviates the need for the push cylinder 72, the pressure spring 73 and the conductive spring wire 78. Thus, the production cost is reduced, the assembly is more convenient and the production capacity is therefore enhanced.

The most important part that is eliminated is the pressure spring 73. As a result, the bad electrical continuity associated with the fatigue of the pressure spring 73 is avoided. Thus, the malfunction rate is reduced and the service life is prolonged.

Figure 6:
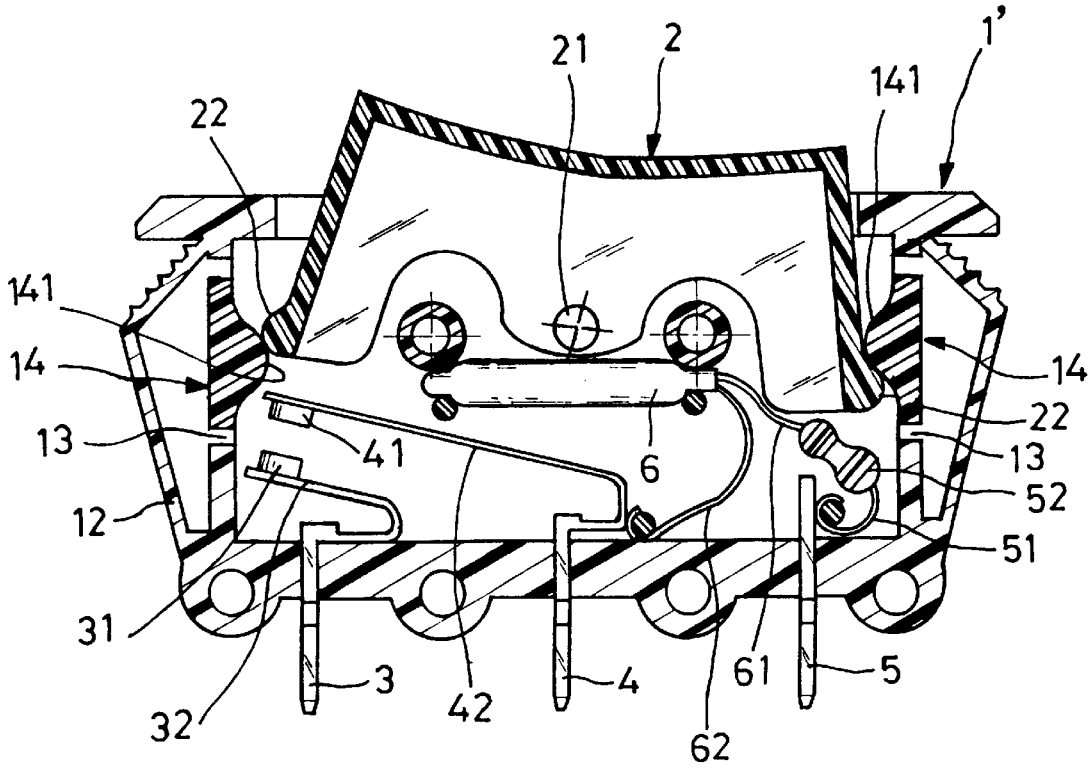
FIG. 6 is a sectional view of another preferred embodiment of the present invention.
Figure 7:
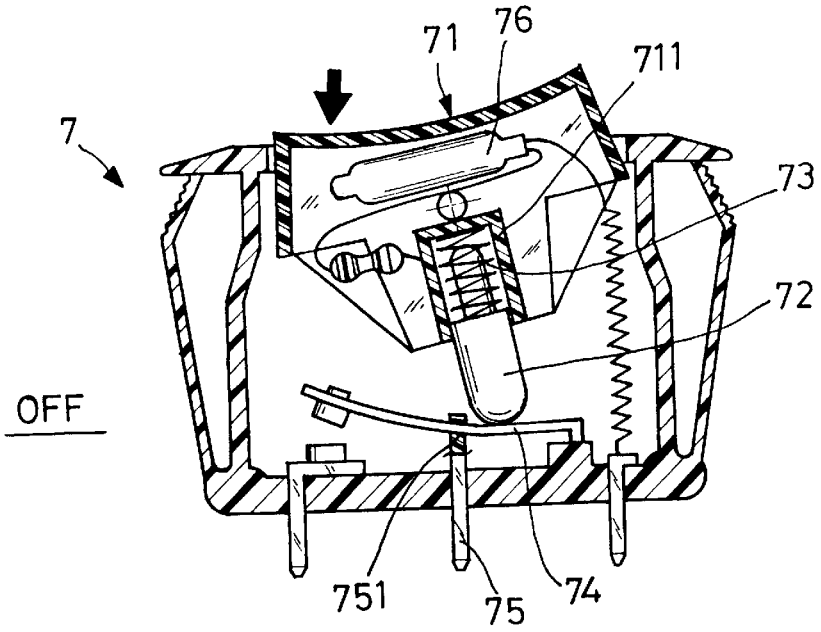
FIG. 7 PRIOR ART
FIG. 7 is a sectional view of a conventional see-saw switch showing the Off-state.
Figure 8:
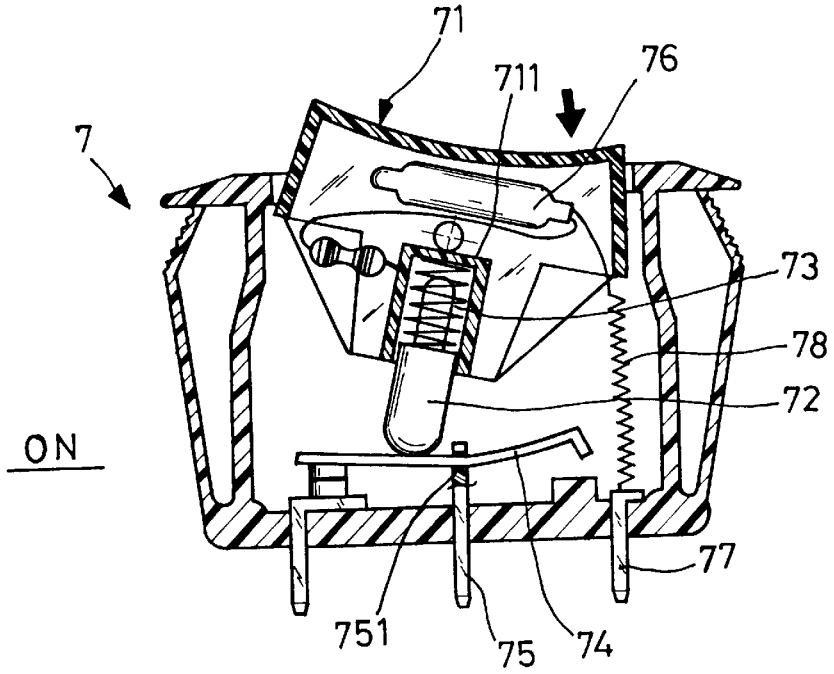
FIG. 8 PRIOR ART
FIG. 8 is a sectional view of a conventional see-saw switch showing the On-state.

Furthermore, the design of the swinging movement of the push cylinder 72 at center of the switch housing of the prior art is removed. Thus, that space is saved so that the whole body of the switch housing 1', as shown in FIG. 6, can be lowered, and the volume of the switch housing becomes smaller and it doesn't occupy much space. Meanwhile, the application range becomes wider.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A see-saw switch comprising:

a switch housing formed by a hollow case, said hollow case having at least one end thereof with an opening formed therethrough;

a button pivotally mounted in said switch housing, said button having a projection formed on at least one end thereof;

three conductive plates extending through said switch housing, a first of said conductive plates having a first bending portion disposed in said switch housing, said first bending portion having a first conductive boss fixed thereon, a second of said conductive plates having a second bending portion disposed in said switch housing, said second bending portion having a second conductive boss fixed thereon in opposed spaced relationship with said first conductive boss, said second bending portion being displaced to position said second conductive boss in contact with said first conductive boss responsive to a displacement of said button from a first position to a second position, a third of said conductive plates being coupled to a resistance element;

a neon lamp disposed in said switch housing under said button and secured by a plurality of locating posts of said switch housing, said neon lamp having a pair of conductive wires respectively coupled to said second conductive plate and said resistance element for indicating electrical coupling between said first conductive boss and said second conductive boss; and, at least one resilient piece coupled to said switch housing, said at least one resilient piece having one end fixed to said hollow case and an inner rim face formed on an opposing end thereof and extending through said opening in said end of said hollow case, said inner rim face having an arched body contour contacting said projection formed on said at least one end of said button for releasably fixing said button in said first and second positions.

2. The see-saw switch as recited in claim 1, wherein said hollow case has an opening formed through each of two opposing ends thereof, said button having a pair of projections respectively formed on opposing ends thereof, and a pair of resilient pieces are coupled to said switch housing, said inner rim faces of said resilient pieces respectively extending through said openings in said hollow case for respective contact with said pair of projections.

* * * * *